US005535486A

United States Patent [19]

Cabili

[11] Patent Number: 5,535,486

[45] Date of Patent: Jul. 16, 1996

[54] SPRING-WIRE PAPER CLIP

[76] Inventor: Camilo P. Cabili, 12 Diego Silang, New Capitol Estates, Diliman, Quezon City, Philippines

[21] Appl. No.: 255,965

[22] Filed: Jun. 7, 1994

[51] Int. Cl.[6] ..... B42F 1/00

[52] U.S. Cl. ..... 24/67.9; 24/546; 24/547

[58] Field of Search ..... 24/67.9, 545, 546, 24/547

[56] References Cited

U.S. PATENT DOCUMENTS

| | | | |
|---|---|---|---|
| 186,314 | 1/1977 | Davis | 24/546 |
| 742,892 | 11/1903 | McGill | 24/547 |
| 742,893 | 11/1903 | McGill | 24/547 |
| 2,269,649 | 1/1942 | Comley | 24/547 |
| 2,822,593 | 2/1958 | Sponsel | 24/67.9 |
| 5,329,672 | 7/1994 | Froehlich et al. | 24/67.9 |

*Primary Examiner*—Victor N. Sakran

[57] ABSTRACT

This invention is about a spring-wire paper clip formed in a single plane without any overlapping of its parts, with a stronger hold because of the unique configuration of its inner frame whose left leg, instead of moving straight downward curves inward to the right, diagonally, where it joins the right leg of the outward frame, both moving straight down parallel and close to each other in forming a stronger gripping engagement on papers. This unique inner frame also makes possible a novel positioning of the inner frame's end portion underneath and hooded by its own uppermost loop, which together with the outer frame's end portion positioned close to the very top of the clip, practically eliminates any damage to paper held.

The unique inner frame also makes it possible for manufacturers to select the strength of the clip's hold, without having to radically change its configuration, to use less wire, and to make slimmer or smaller clips which occupy less space at the left corner.

This clip is manufactured and handled by the user in much the same way as the currently popular Gem-type of of spring-wire paper clips.

3 Claims, 2 Drawing Sheets

SPRING-WIRE PAPER CLIP

BACKGROUND OF THE INVENTION

1. Field of the Invention

This invention relates to pager clips made of metallic spring wire of the "Gem" type currently in popular use, formed along a single plane without any overlapping of its members and designed to hold multiple sheets of paper with a minimum of damage to the paper. In particular, this invention relates to several improvements of the said Gem-type paper clip, with a perceptibly stronger hold by reason of a new inner-frame configuration and with the added advantage of practically eliminating any scratching, tearing or other forms of damage to the papers held together.

2. Prior Art

The Gem-type of paper clip, although it is without doubt the most popular spring-wire clip in contemporary use, is now more liable to slide off the papers it holds because of the widespread use of smooth and relatively thick copying paper. The manufacturers of the "Gem" cannot strengthen its hold unless they radically change its configuration.

A "Konaclip" patented in 1900 and 1905 has a corkscrew inner member which goes straight down from its uppermost loop to the middle of its outward frame, but not close to the right and left parts of such outward frame. The Konaclip never gained popular acceptance because its hold was weak, it often got entangled with other clips in its small conatainer boxes and it had an ugly look.

A paper clip stamped from sheet metal appeared early in this century, but also did not gain public acceptance because it had an ugly serrated tongue which directly went down the middle of its outward frame,which was not only ugly looking but also gave an ugly crimp on paper.

A spring-wire clip is mentioned here although it is not really relevant prior art. In the first place, it is not formed in a single plane, but has legs crossing and overlapping each other at two points and not along a short length of parallel wires. Its hold was not strong and its look was not aesthetically pleasing because of its complicated appearance.

SUMMARY

This invention provides a spring-wire paper clip with an outward frame similar to that of the Gem paper clip except that its end portion is positioned close to the very top of the clip. Its inner frame is very different from the Gem's, because from the left side of the uppermost U-shaped loop, its wire does not proceed downwards to form an inner loop, but circles back upon itself, toward the right side of the outward frame, from which it moves straight down parallel to, and close alongside, the said outward frame, thereby jointly forming a strong holding engagement of approximately one centimeter. Thence it finally forms a lower loop whose end portion positioned underneath the lower left part of the uppermost loop, cannot damage paper. Since the other end portion of the clip is positioned close to the very top of the clip, it likewise cannot damage paper on which the clip is used.

An object of this invention is to provide a springwire paper clip stronger than the one currently in popular use, without crimping the papers on which it is inserted.

An object of this invention is to provide its manufacturer the option of choosing its most desirable gripping strength without significantly altering configuration.

Another object of this invention is to provide a clip which never scratches, tears or penetrates the papers upon which it is used.

Another object of this invention is to provide a clip which, even if attached nearer to the upper left corner of papers, in a slanting position pointing to the left side so that it occupies materially less space on the papers, nevertheless does not slip off easily.

Another object of this invention is to provide a slimmer or smaller clip, using less wire and effecting cost savings for its manufacturer, more pleasing to the eye and yet not sacrificing its holding strength.

DETAILED DESCRIPTION OF THE DRAWINGS AND OF PREFERRED EMBODIMENTS

Figure 1:
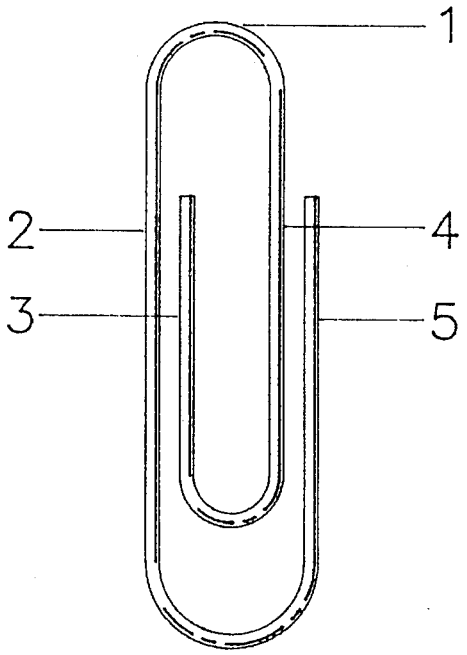
FIG. 1 shows the front perspective of the improved paper clip.

Referring to FIG. 1, this improved spring-wire clip is shown to have a new and stronger gripping engagement at its right side, formed by the parallel and close joining (1) of its outward right-side leg with its left inner leg. A novel configuration of the entire inner frame of this clip has resulted because the left leg, after curving down front its axis (2) at the uppermost loop, does not move straight down but instead turns inward to the right, diagonally, before finally moving down at the right side.

From there, the inner leg forms a U-shaped loop at the bottom of the inner frame, and moves upward to end in a unique position (3) underneath the bottom left side of the uppermost loop where, together with the position of the end portion (4) of the outward frame of the clip, the combined positions of its two ends practically eliminate any penetration or tearing of paper. A surprising result is that even surface scratching of paper has been eliminated.

Since the end portion of the outward frame is positioned right beside the leftmost part of the uppermost loop, it is not only damage to paper that is prevented, but also entanglement with other clips.

The stronger grip engagement (1) may be moved by the manufacturer nearer or further from the base of its strength at its axis (2) to choose the strength of its hold on paper according to public acceptance.

The stronger grip of this wire paper clip also makes it possible for its manufacturer to utilize less wire to effect cost savings and also slimmer or smaller configurations without sacrificing the security of its hold on paper.

The stronger grip of this invention also makes it likely for its users to clip documents nearer the left corner, or slanting position pointing the bottom of the clip toward the left side of the documents, without making the users apprehensive about the clip sliding off the edge.

The basic preferred embodiment of this invention is that which has its unique inner frame formed as described in the foregoing and shown in FIG. 1 and which has its end parts positioned in the novel way also described above and shown in FIG. 1.

Figure 2:
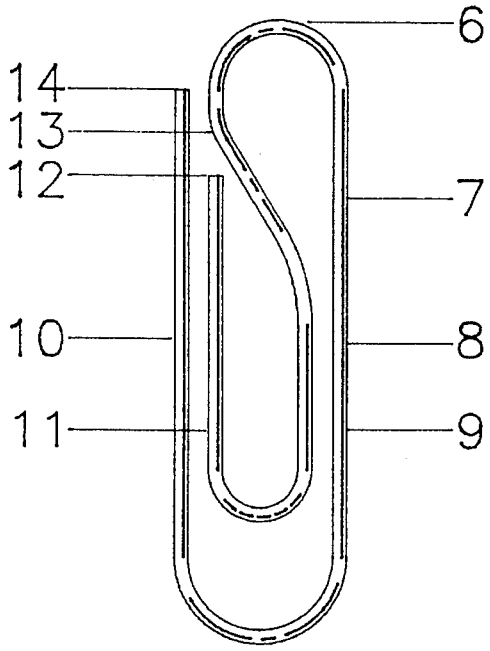
FIG. 2 shows the side perspective of the improved paper clip.
Figure 3:
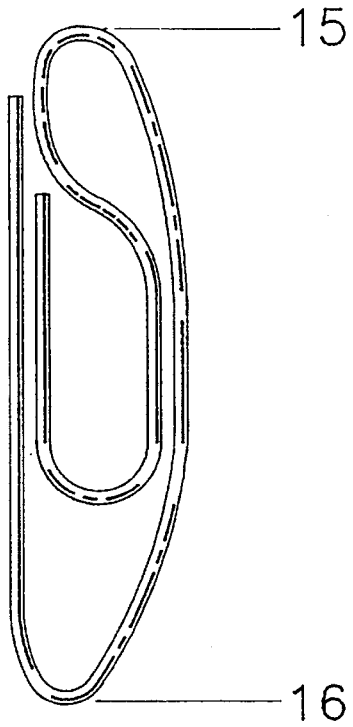
FIG. 3 is the plan view of another preferred embodiment of the invention which slightly varies from the basic preferred embodiment.
Figure 4:
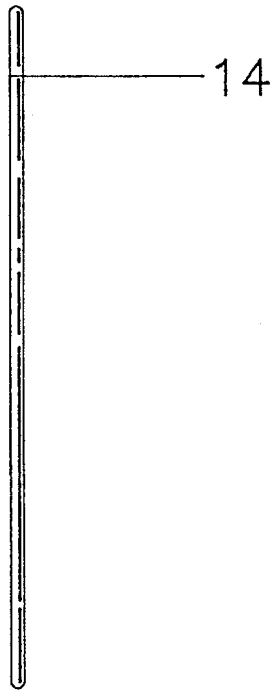
FIG. 4 shows the left side view of the invention.

Referring to FIG. 2, is shown to be formed in a single plane without overlapping of any of its part. Its outward and enclosing left end is shown positioned quite close to the very top of the clip.

The inventions claimed are:

1. A spring-wire paper clip, formed in a single plane with no overlapping parts, with a stronger gripping engagement at the middle right-side of the clip and formed by two of its downward extending legs, not just one, gripping jointly at a position significantly closer to the uppermost axis and base of its gripping strength than other conventional clips such as the popular "Gem" clip, with a unique inner frame making possible likewise novel positions of its end portions which practically eliminate any penetration, tearing and even scratching of the surfaces of the papers held together, because its inner end is hooded by the underside of the uppermost loop of the clip and the outward end is positioned very near the top of the clip.

2. A spring-wire paper clip, in accordance with claim 1, wherein its strong-gripping engagement portion is easily moved by the manufacturer nearer or further relative to the axis of its holding strength at the topmost loop of the clip, which allows said manufacturer to vary or select its holding strength without having to greatly alter its configuration.

3. A spring-wire paper clip, in accordance with claim 1, which allows the manufacturer to use less wire for cost-saving, or make a slimmer or smaller clip without danger of weakening its hold.

* * * * *